US005758679A

United States Patent [19]

Tamburelli

[11] Patent Number: 5,758,679

[45] Date of Patent: Jun. 2, 1998

[54] LID TENT COMBINATION

[76] Inventor: Joseph Samuel Tamburelli, 25442 Esrose Ct., El Toro, Calif. 92630

[21] Appl. No.: 741,024

[22] Filed: Oct. 30, 1996

[51] Int. Cl.[6] ..... E04H 15/06

[52] U.S. Cl. ..... 135/88.09; 135/88.16; 135/119

[58] Field of Search ..... 135/88.01, 88.03, 135/88.07, 88.09, 88.14, 88.15, 88.16, 96, 119, 115, 117

[56] References Cited

U.S. PATENT DOCUMENTS

| | | | |
|---|---|---|---|
| 1,988,380 | 1/1935 | Goldberg | 135/88.09 |
| 3,255,466 | 6/1966 | Weizer | 135/88.16 X |
| 3,499,175 | 3/1970 | Orberg | 135/88.16 X |
| 3,603,330 | 9/1971 | Halldorson | 135/88.16 |
| 3,746,386 | 7/1973 | Woodward | 135/88.14 |
| 4,496,184 | 1/1985 | Byrd et al. | 135/88.09 X |
| 4,548,438 | 10/1985 | Myers | 135/88.16 X |
| 4,955,660 | 9/1990 | Leonard | 135/88.09 |
| 4,964,669 | 10/1990 | Geier | 135/88.09 X |

*Primary Examiner*—Lanna Mai
*Attorney, Agent, or Firm*—Curtis L. Harrington

[57] ABSTRACT

A tent and truck bed combination employs a series of fasteners, typically snaps, placed around the periphery of a truck bed lid which lifts at an angle with respect to the bed. A cloth portion of the tent material fastens to the snaps along the bottom surface adjacent to the edge of the lid, and includes a pair of side triangular portions and a rear rectangular portion joined to the triangular portions with zippers along their intersecting corner length.

5 Claims, 3 Drawing Sheets

LID TENT COMBINATION

FIELD OF THE INVENTION

The present invention relates to recreational vehicles and tests, and more specifically to a new tent structure combinable with a vehicle lid to form a quickly deployable tent structure useful in camping.

BACKGROUND OF THE INVENTION

Tents and camping vehicles have been known for some time and range from light weight tents for two which can be carried in a hand bag, to trailer based tents which have a highly expandable top portion.

Each of these tent structures are dedicated solely to tent use. However, what is needed is an inexpensive, complementary portion which will combine with another other structures which may either already be in use or which have other uses. The needed tent structure should work in combination with the other available structures, and be easy to disassemble to allow full use of the other structures with which it is associated. The tent structure should be inexpensive, have a minimus setup time and should collapse to a small storage volume.

The resulting tent combination should be adaptable for dry weather, rainy weather and still provide the ability to achieve some shelter and protection in very windy conditions.

SUMMARY OF THE INVENTION

The tent and truck bed combination employs a series of fasteners, typically snaps, placed around the periphery of a truck bed cover. The cloth portion of the tent material includes a pair of side triangular portions and a rear rectangular portion joined to the triangular portions with zippers along their intersecting corner length. The cloth portions are fastened to the inside under portion of the truck bed cover which is pivotally mounted on the forward portion of a pickup truck bed. When the lid is opened, usually with spring loaded piston-type bias devices, the cloth portio of the tent material is simply snapped or fastened to the under siide of the lid. Screen panels on the side and rear cloth portions enable air to pass through, but shed water in the event of rain. Where wind becomes a severe problem, the lid can be lowered causing the cloth portions of the tent to drape about the outside of the vehicle, the lid thereby shutting out the wind. The bottom edges of the cloth tent material is held downward with the help of elastic cords and magnets formed into the lower sewn fold of the cloth tent material.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
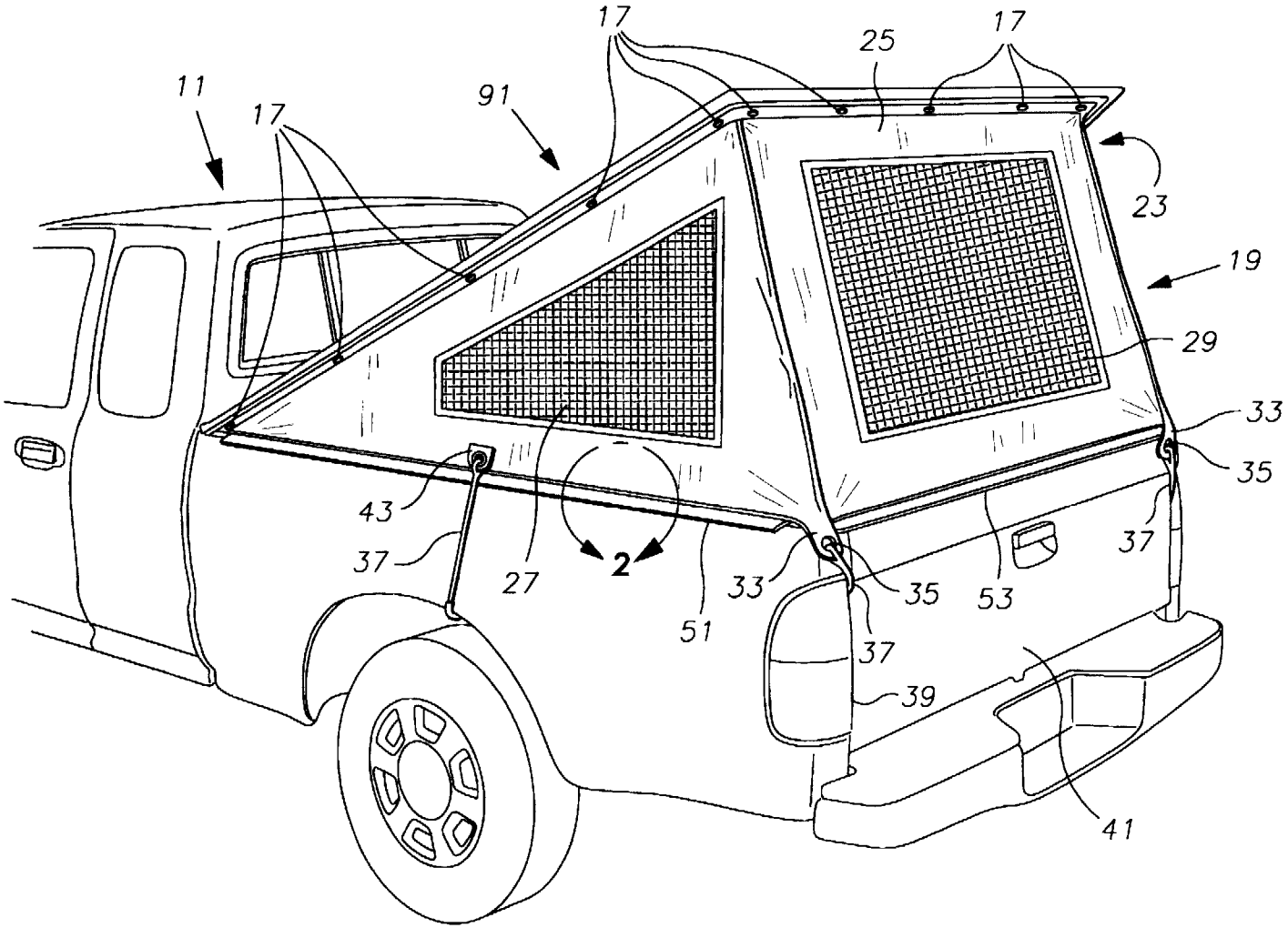
FIG. 1 is a perspective view of the rear of a pickup truck and illustrating a lid in an up position and the cloth portion of the tent material secured by the lid and the truck body.

The description and operation of the invention will be best described with reference to FIG. 1. FIG. 1 illustrates a pickup truck 11 having a pivotally mounted lid 13 which is designed to open and close with respect to the rear bed portion 15 of the truck 11. Without more, the lid 13 would simply close down on the bed portion 15 to form a sealed enclosure.

Along the lower inside portion of the lid 13, a series of snaps members 17 are seen securing the cloth tent portion 19 to the underside of the lid 13. The cloth tent portion 19 includes a left side panel 21, a right side panel 23 (not immediately seen in FIG. 1) and a rear panel 25.

The left side panel 21 has a left side screen panel 27 which generally follows the shape of the left side panel 21, while rear panel 25 has a rectangular screen panel 29. Right side panel 23 has a right side screen panel 31 which also generally follows the shape of the right side panel 23. Ideally, the screen panels 27, 29 and 31 will be of sufficient fineness to shed water while allowing breezes of air to pass through.

As can be seen, the tent cloth portion 19 approximately doubles the covered volume otherwise available in the rear bed 15, and enables a comfortable height as would be experienced in most small tents. This is an optimum shape, since many of the smaller tents follow this design providing for an expanded head room portion and a taper in the direction of the foot space.

As can be further seen in FIG. 1, the side panels have lower tail portions 33 having reinforced eyelets 35 to accomodate cord 37 which can be guided through the slot clearance 39 between the side panel of the bed 15 and the tail gate 41. The cord 37 may have an end which is attached to the underside of the chassis of the truck 11. Ideally the cord 37 is an elastic stretchable cord.

In addition, the side of the left side panel 21 illustrates a loop structure 43 having a cord 37 having a lower end attached to the inside of the wheel. The left side panel 21 has a lower edge 51 having a series of magnets sewn into the seam to promote adherence of the lower edge 51 against the side of the vehicle. Similarly, the rear panel 25 has a lower edge 53 also having a series of magnets carried in the seam to promote adherence of the lower edge 53 against the tail gate 41 of the vehicle.

Figure 2:
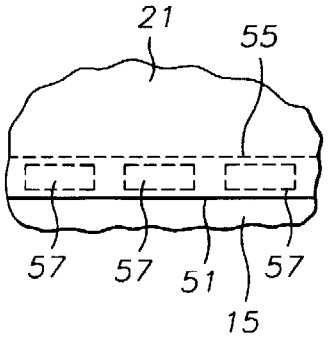
FIG. 2 is a view along line 2—2 of FIG. 1 and illustrating a lower seam capturing a line of magnets to enhance the stability of the lower edge of the side panel 21 against the outer surface of the rear bed of the truck.

Referring to FIG. 2, a view around line 2 - 2 illustrates a folded seam 55 which captures a series of magnets 57, shown in phantom.

Figure 3:
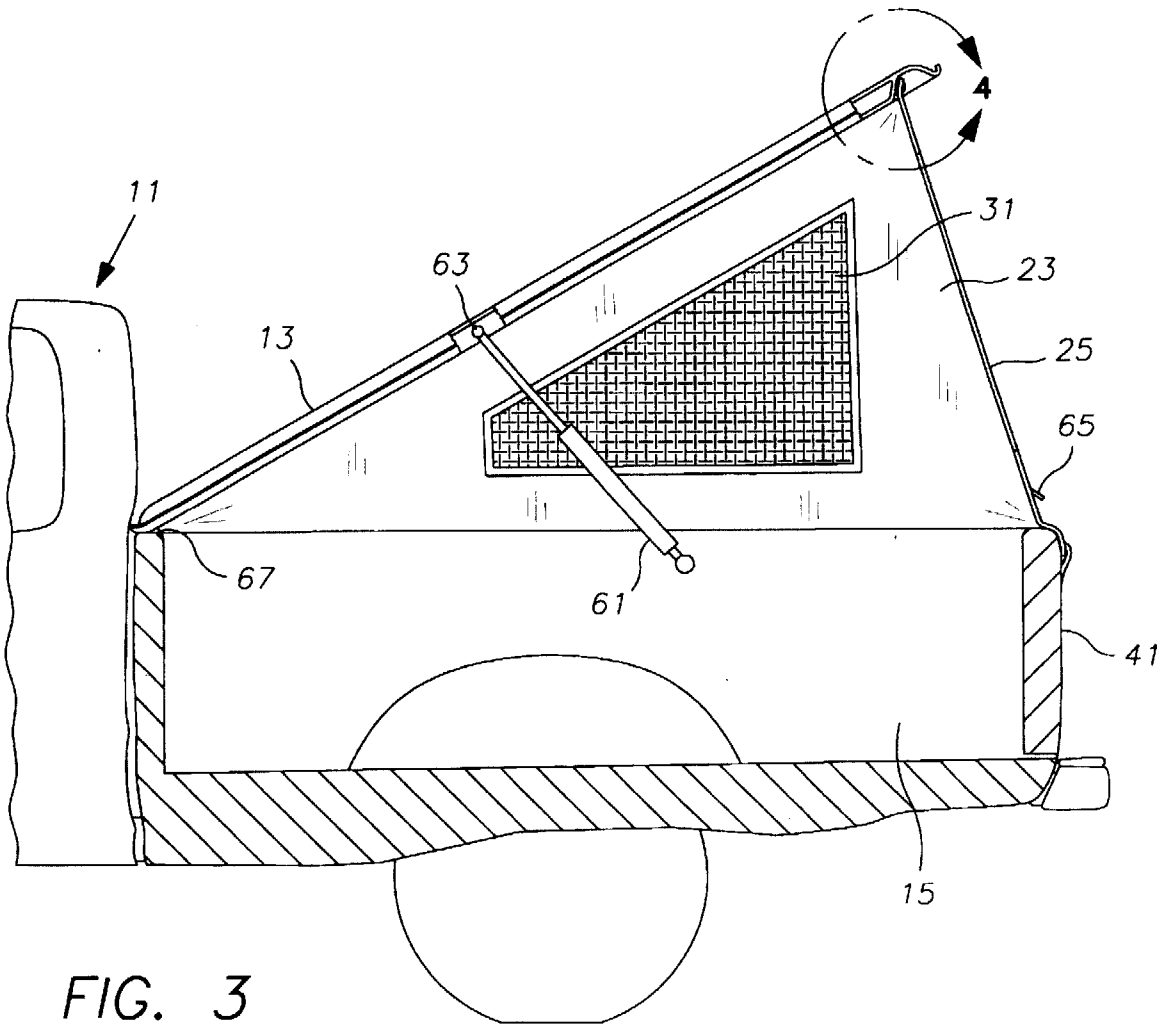
FIG. 3 is a side sectional view looking into the rear bed of the truck of FIG. 1 and illustrating the the spring cylinder and its relationship to the lid.

Referring to FIG. 3, a sectional view taken along the medial center of the truck 11 illustrates further details of the invention. A spring biased cylinder 61 has a lower end attached to an inner structure of the bed 15 of the truck 11, and the other end to a rotational pin 63 mounted on the inside of the 13. In this configuration, the cylinder 61 may be just powerful enough to lift the lid 13 only when it is opened more than half way. In the alternative, the lid 13 is fitted with a latch which enables it to be latched down with respect to the bed 15. A double zipper or slide fastener 65 is seen at the boundary between the right side panel 23 and the rear panel 25. This zipper enables the rear panel 25 to be unzipped from the right side panel 23 to facilitate entry when the tail gate 41 is up. As can be seen, the lid 13 is pivotally attached to the forward end of the bed 15 through the use of a hinge 67.

Figure 4:
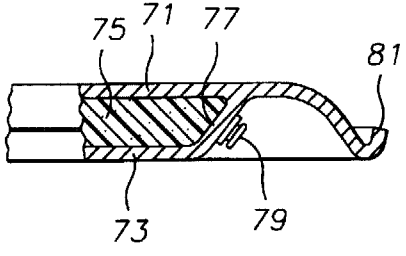
FIG. 4 is a detail view taken along line 4 of FIG. 3 and illustrating the placement of the snap fasteners against the expanded portion of the lid used for reinforcement.

Referring to FIG. 4, a detail taken through line 4-4 illustrates that the lid 13 has a central double wall reinforcement, including an upper wall 71 and a lower wall 73 and separated by a structural foam filler 75. the walls 71 and 73 are separated by an angled wall 77, and it is this angled wall 77 which is equipped with a snap member 79 and which will engage the snap members 17. The snap member 79 will ideally be a male snap member, and the snap members 17 will ideally be female snap members. As is also shown, the lid 13 may have an upturned edge 81 or other reinforcing or protective structure.

Figure 5:
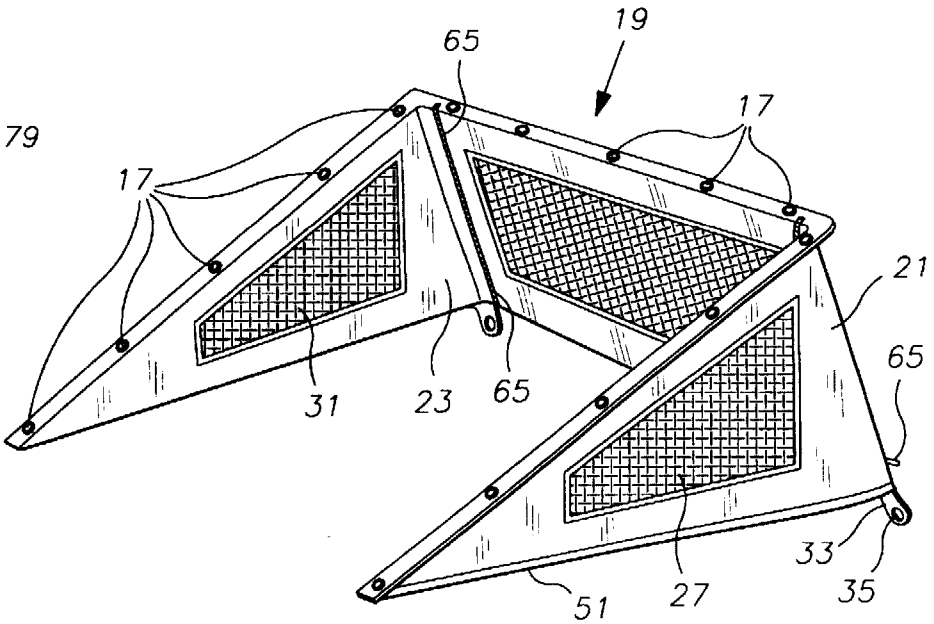
FIG. 5 illustrates a perspective isolated view of the cloth tent portions and illustrating the zoppered connection between the rear panel and side panels.

Referring to FIG. 5, the cloth tent portion 19 is shown in isolation, but in the position it will assume as shown in FIGS. 1 and 3. In addition to the double zipper portion of the slide fastener 65, the entire slide fasterner can be seen. The top of the cloth tent portion 19 may be continuous or it may be detachable in much the same way any slide fastener 65 end may be detached. The upper edge of the cloth tent portion 19 is seen as having a continuous upper extent.

Figure 6:
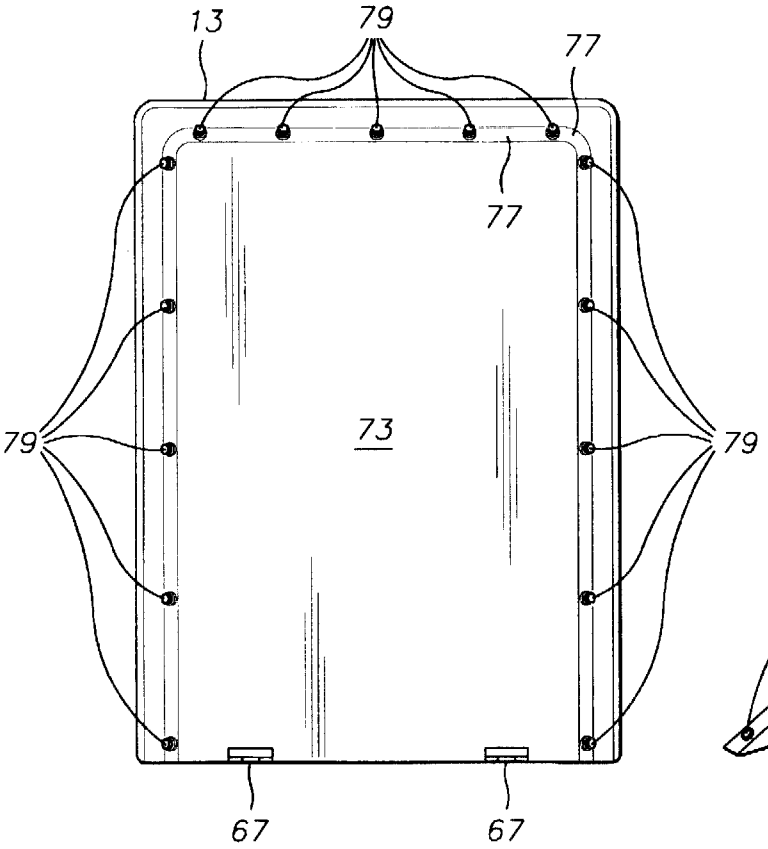
FIG. 6 illustrates a view of th eunderside of the lid portion and emphasizing the transition of the reinforced portion carrying the fasteners for engaging the cloth tent portions.

The overhang of the lid 13, coupled with the mounting of the top of the cloth tent portion 19 significantly inward of the outer edge of the lid 13 contributes to the rain resistance of the lid 13 and cloth tent portion 19, collectively referred to as the lid tent 91. Referring to FIG. 6, the underside of the lid 13 is illustrated to better show the lower wall 73 and the extent of the angled wall 77 as extending peripherally around at least the side and rear perimeters of the lid 13.

Even though the invention has been described with reference to a cloth portion 19 which can interfit with a lid 13 made of fiberglass or reinforced plastic or other lightweight and durable material, it will be seen that the structure of the present invention can be advantageously applied to a variety of structures.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A tent for attachment to a tilted lid pivotable with respect to the bed of a vehicle, comprising:

a first triangular cloth panel having a first top edge, a first bottom edge and a first rear edge and having a first fastening structure along said first top edge, magnetic members attached along said first bottom edge, and a first elongate fastener along said first rear edge;

a second triangular cloth panel having a second top edge, a second bottom edge and a second rear edge and having a second fastening structure along said second top edge, magnetic members attached along said second bottom edge, and a second elongate fastener along said second rear edge; and a rear cloth panel having a top edge and including a third fastening structure along said top edge, first side edge having a third elongate fastener matable with said first elongate fastener of said first rear edge to join said first rear edge with said first side edge, a second side edge having a fourth elongate fastener matable with said second elongate fastener of said second rear edge, to join said second rear edge and said second side edge;

a tilted lid for the bed of a vehicle having a first end closer to an axis of tilt, a second end opposite said first end, a first side end opposite a second side end, both first and second side ends extending between said first and said second ends, said first fastening structure of said first triangular cloth panel attached to said lid adjacent said first side end, said second fastening structure of said second triangular cloth panel attached to said lid adjacent said second side end, and said third fastening structure of said top edge of said rear cloth panel attached to said lid adjacent said second end of said lid;

a plurality of first snap members carried by said lid; and wherein said first, second and third fastening structures include a plurality of second snap members as said first, second and third fastening structures matable with said plurality of first snap members, and wherein a central portion of said lid includes an upper wall, and a lower wall spaced apart from the upper wall, with structural connected between said upper wall and said lower wall, and wherein said plurality of said first snap members are supported between said upper and said lower wall.

2. The tent as recited in claim 1 wherein said first and said second triangular cloth panels contain a screen panel for admitting air and for shedding water.

3. The tent as recited in claim 1 and further including an angled wall connected between said upper wall and said lower wall, and wherein said angled wall supports said plurality of said first snap members.

4. The tent as recited in claim 1 wherein said rear cloth panel has a pair of lower supports for holding said rear cloth panel down with respect to a vehicle.

5. The tent as recited in claim 1 wherein said first and second triangular cloth panels each have a lower support for holding said first and second triangular cloth panels down.

* * * * *